United States Patent [19]

Gurzenda

[11] 3,994,043

[45] Nov. 30, 1976

[54] DOOR BUMPER

[75] Inventor: William V. Gurzenda, Rockwood, Pa.

[73] Assignee: Rockwood Manufacturing Company, Rockwood, Pa.

[22] Filed: Sept. 19, 1975

[21] Appl. No.: 615,059

[52] U.S. Cl. ..... 16/86 A; 24/102 SL; 24/214; 248/203; 403/9

[51] Int. Cl.[2] ..... E05F 5/02; E05F 5/06

[58] Field of Search ..... 16/86 A; 248/203, 251; 403/9; 24/90 E, 90 J, 92, 94, 102 SL, 104, 106, 110, 214

[56] References Cited

UNITED STATES PATENTS

| | | | |
|---|---|---|---|
| 1,338,883 | 5/1920 | Tarkington | 24/214 |
| 1,379,192 | 5/1921 | Lartev | 24/102 SL |
| 3,050,770 | 8/1962 | Morse et al. | 16/86 A |
| 3,362,040 | 1/1968 | Gurzenda | 16/86 A |
| 3,484,891 | 12/1969 | Borgen | 16/86 A |

*Primary Examiner*—Werner H. Schroeder
*Assistant Examiner*—Conrad L. Berman
*Attorney, Agent, or Firm*—Stevens, Davis, Miller & Mosher

[57] ABSTRACT

A door bumper having no visible screws for mounting on a wall for contact with a door knob when the door is opened. A rubber bumper is carried on a housing which is non-detachably secured to the wall by a backplate. The backplate has a flattened V shaped spring with two radially outwardly extending ends which engage a circular notch extending around the inner periphery of the housing.

8 Claims, 5 Drawing Figures

DOOR BUMPER

This invention relates to wall or door bumpers and more particularly to a wall bumper or door stop adapted to be placed on the wall and preferably in a position to contact the knob of the door when opened. In many instances, it is not practical to use a door stop or bumper mounted upon the floor or baseboard of a room and in that event a bumper is usually secured to the wall and preferably in a position to register with the door knob and to contact it so that the knob will not strike the wall itself. Such types of wall bumpers are well known in the art and although some effort has been made to make them decorative, these efforts have not always been successful.

Such a wall bumper is usually secured to the wall by means of a backplate which can be first secured with a screw, a bolt, a toggle bolt, or other fastening means depending upon the wall surface. The housing of the wall bumper which holds the resilient bumper portion is then secured to the backplate usually by visually obtrusive screws. These screws not only detract from the appearance of the wall bumper but also present a convenient target for vandals to loosen or remove the bumper from the wall.

The removal of such hardware from public buildings by vandals has become an increasing problem and various efforts have been made to prevent this, such as limiting access to the retaining screws or hiding a single retaining screw in the bottom of the bumper housing.

It is an object of the present invention to provide a new and improved wall bumper which has no visible securing screws.

It is a further object of the present invention to provide a wall bumper which cannot be removed from the wall after it has been secured in place without destruction of at least part of the bumper.

It is a further object of the present invention to provide a wall bumper in which the housing can be made freely rotatable in relation to its backplate so as to discourage attempts to remove it from the wall.

These and other objects will become apparent from a detailed consideration of the present invention as disclosed in the accompanying drawings in which.

Figure 1:
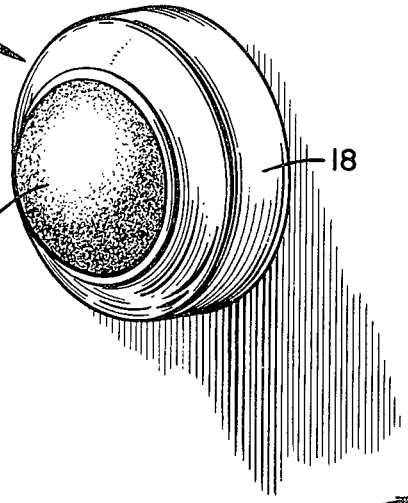
FIG. 1 is a perspective view of the present wall bumper mounted on a wall.

Turning now to the drawings in greater detail, which illustrates one preferred embodiment of the present invention, the housing 10 has a central circular opening through which a bulbous portion of a resilient rubber bumper 12 projects. The rubber bumper has a peripheral flange portion 16 which is of greater diameter than the opening of the housing so that the resilient rubber portion is retained in the housing and cannot be pulled outwardly.

The inner periphery of the sidewall 18 of the housing has a notch means in the form of a circular groove 20 preferably extending around the entire inner circumference.

Figure 2:
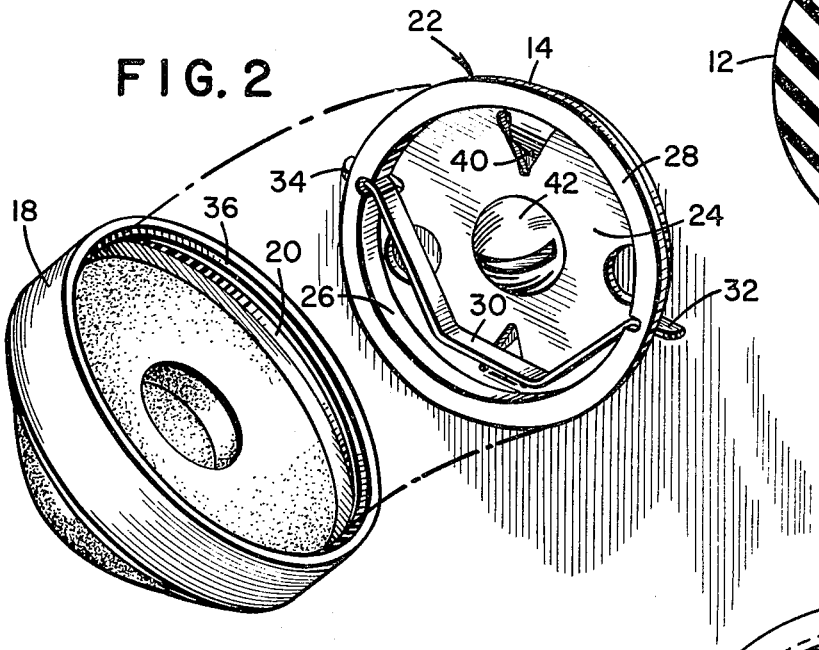
FIG. 2 is an exploded perspective view showing a backplate mounted on a wall and a housing ready to be positioned over the backplate.
Figure 4:
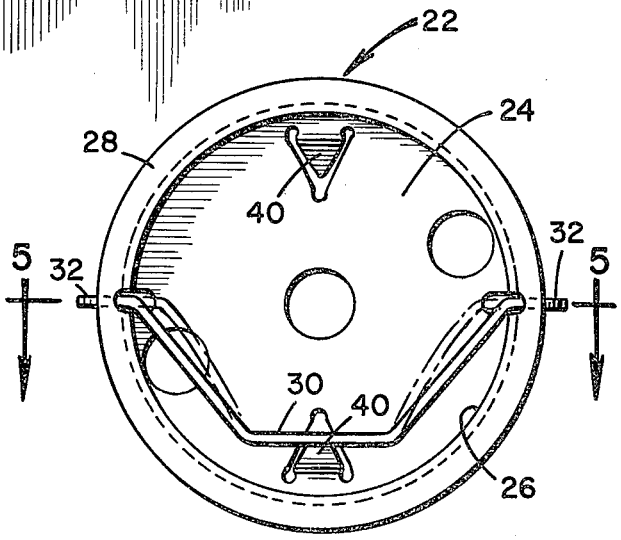
FIG. 4 is an elevational view of the backplate.
Figure 5:
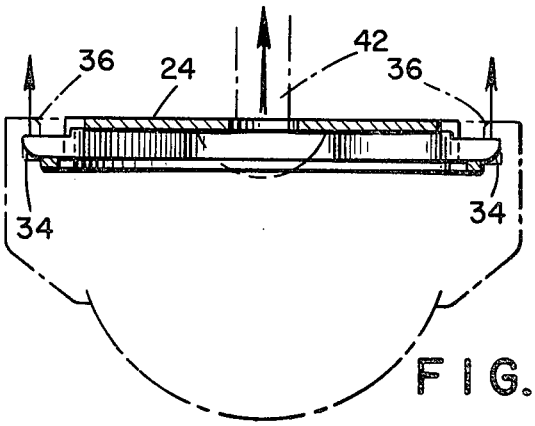
FIG. 5 is a sectional view of the backplate along line 5—5 of FIG. 4 showing the housing and bumper in phantom lines to better illustrate its positioning over the backplate.

The backplate 22 has a flat portion 24 surrounded by an outwardly extending lip 26 which terminates in a radially extending flange 28. The lip 26 defines a recess in which a spring means 30 having a generally V configuration is held, this spring having two radially outwardly extending portions 32 which are rounded on their outward edges at 34, as shown in FIGS. 2 and 5. As shown in FIGS. 2 and 4, this spring may be flattened at its point or apex.

The inner periphery of the housing is preferably chamfered at 36 so as to present a slanting surface which will engage with the rounded edges 34 of the spring and thus cam over them and force the spring ends radially inwardly when the housing is pushed over the backplate. As soon as the portions 32 of the spring 30 seat in the peripheral groove 20 the spring once again returns to its normal position with the square edges (opposite the rounded corners 34) engaging in the groove 20. When the housing is so positioned over the backplate there are no visible screws or other fastening means and it is impossible to remove the housing from the backplate by any conventional means. If desired, the housing and bumper can be removed by cutting a hole through the resilient rubber so as to contact one portion of the V-shaped spring or the entire rubber portion can be cut away to be later replaced. However, since such door bumpers are customarily permanently mounted, it is not usual that such removal will be needed.

The backplate may have two cutout V-shaped portions 40 which are bent to extend as sharp points rearwardly of the backplate so that they will dig into the wall surface upon which the backplate is mounted, thus enabling a non-rotational fastening by means of a single bolt 42. A central recessed portion may be provided in the back of the rubber bumper to make additional room for the head of the bolt 42.

Figure 3:
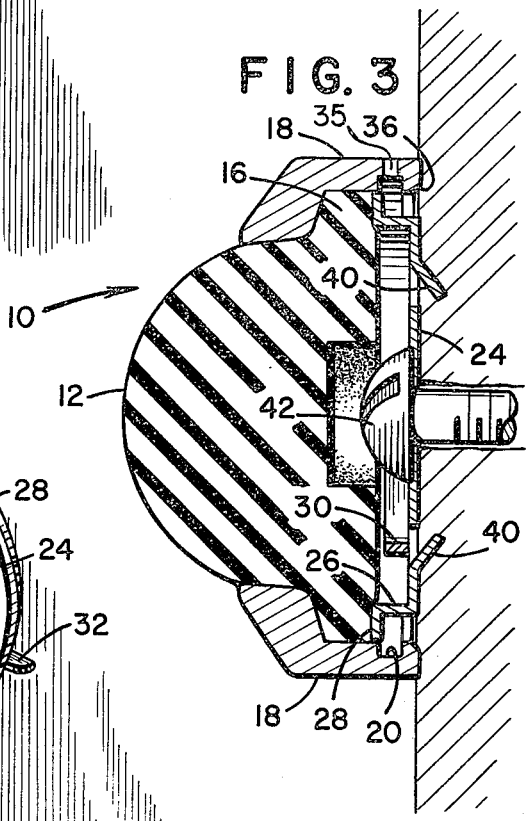
FIG. 3 is a sectional view of a complete wall bumper mounted upon a wall.

As shown in FIG. 3, the flange portion 16 of the resilient rubber bumper may be of such thickness that there is a tight frictional engagement between it and the flange 28 of the backplate so that there can be little or no relative rotation between these parts in an assembled bumper. Optionally, the flange 16 of the rubber bumper can be made thinner so as to allow a small space between it and the backplate flange to permit the housing to be rotated in relation to the backplate and frustrate attempts to unscrew the entire assembly from the wall. It is contemplated that the spring could be made in other configurations with, for example, only one edge protruding from the periphery of the backplate and one or more stationary lugs projecting from an opposing portion of the backplate so that the housing would first be hooked over the stationary one or more lugs and then forced over the spring-loaded lug to secure the housing to the backplate.

It is also contemplated that a backplate of the type presently disclosed could be used for other purposes such as non-removable mounting of tubular bodies or other devices to a wall or floor; these devices include ornamental hardware, pipe railing, or fastenings for any other hardware where a permanent fastening is desired.

It is also contemplated that the sidewall of the housing could have an opening 35 connecting to the groove 20 so that a tool could be inserted through the opening and the housing rotated in relation to the backplate so as to bring the tool in contact with the outer end 32 of the spring so that the spring can be pushed radially inwardly to permit disengagement of the housing from the backplate. Alternatively instead of the circular groove 20 the housing wall could have two blind holes to receive the portions 32 of the spring; the housing would then be non-rotatable in relation to the backplate. In this alternative construction one of the blind holes could be drilled through to provide an opening for insertion of a pointed tool to force one end of the spring radially inwardly so that the housing could be disconnected from the backplate.

While a circular backplate, housing and bumper have been illustrated, it is within the scope of this invention to make them in other shapes also.

What is claimed is:

1. A door bumper comprising:

a. a housing means having a sidewall with a notch means on the interior thereof, an open back and a front opening smaller than the back opening;

b. a resilient rubber bumper means mounted in said housing means and protruding from said front opening;

c. backplate means for securing the housing to a wall and detachably mounted in the open back of the housing, said backplate means having a flat surface for mounting on the wall and lip means projecting from opposed portions at the edge of the backplate means and substantially perpendicular to the flat surface; and d. means for securing the housing to the backplate comprising outwardly biased spring means projecting radially outwardly from at least one portion of the lip means and engaging the notch means, the end portion of the spring means being rounded on its outward face and the inner periphery of the housing adjacent the notch means being chamfered to facilitate camming in of the spring when assemblying the housing to the backplate by forcing the housing means over the outward ends of the spring means.

2. The bumper of claim 1 in which the notch means extends peripherally around the inner circumference of the housing sidewall.

3. The bumper of claim 1 in which the backplate has an outwardly extending peripheral lip and the spring means is a V-shaped spring flattened at its apex and having two radially outwardly extending end portions projecting through the lip and engaging the notch means.

4. The bumper of claim 1 including an opening from the exterior of the housing to the notch means for insertion of a tool to disengage the end portion of the spring means therefrom.

5. The bumper of claim 1 in which the outwardly extending lip of the backplate has an end portion of the spring projecting therethrough.

6. The bumper of claim 5 in which the lip terminates in a radially extending flange portion.

7. The bumper of claim 5 in which the lip is in engagement with the rear portion of the rubber bumper so that the housing cannot be rotated on the backplate.

8. The bumper of claim 5 in which there is clearance between the lip and the rubber bumper so that the housing can be rotated in relation to the backplate.

* * * * *